United States Patent [19]

Bussard

[11] Patent Number: 4,974,915

[45] Date of Patent: Dec. 4, 1990

[54] MODULAR WORK STATION

[76] Inventor: Janice W. Bussard, 201 N. Fruitport Rd., Spring Lake, Mich. 49456

[21] Appl. No.: 439,248

[22] Filed: Nov. 20, 1989

[51] Int. Cl.[5] ..... A41B 77/08

[52] U.S. Cl. ..... 312/236; 52/239; 108/50

[58] Field of Search ..... 312/236, 198, 203; 98/31.3, 31.5; 52/239, 36

[56] References Cited

U.S. PATENT DOCUMENTS

| | | | |
|---|---|---|---|
| 3,327,440 | 6/1967 | Watkins | 52/239 |
| 3,762,116 | 10/1973 | Anderson et al. | 52/239 |
| 4,378,721 | 4/1983 | Doss | 108/50 |
| 4,625,633 | 12/1986 | Martin | 98/31.5 |
| 4,784,445 | 11/1988 | Ott | 312/236 |
| 4,807,540 | 2/1989 | Priesemuth | 108/60 |

*Primary Examiner*—Joseph Falk

[57] ABSTRACT

A small working station for several persons located in a large interior, including a cluster of individually partitioned areas surrounding a central unit supplying controlled air circulation to the areas; the sizes and shapes of the areas and the number thereof being readily adjustable, as needed from time to time; and the areas containing vertically adjustable shelf and desk work surfaces as well as rotatable or extendable article holders for each reach to anyone.

16 Claims, 9 Drawing Sheets

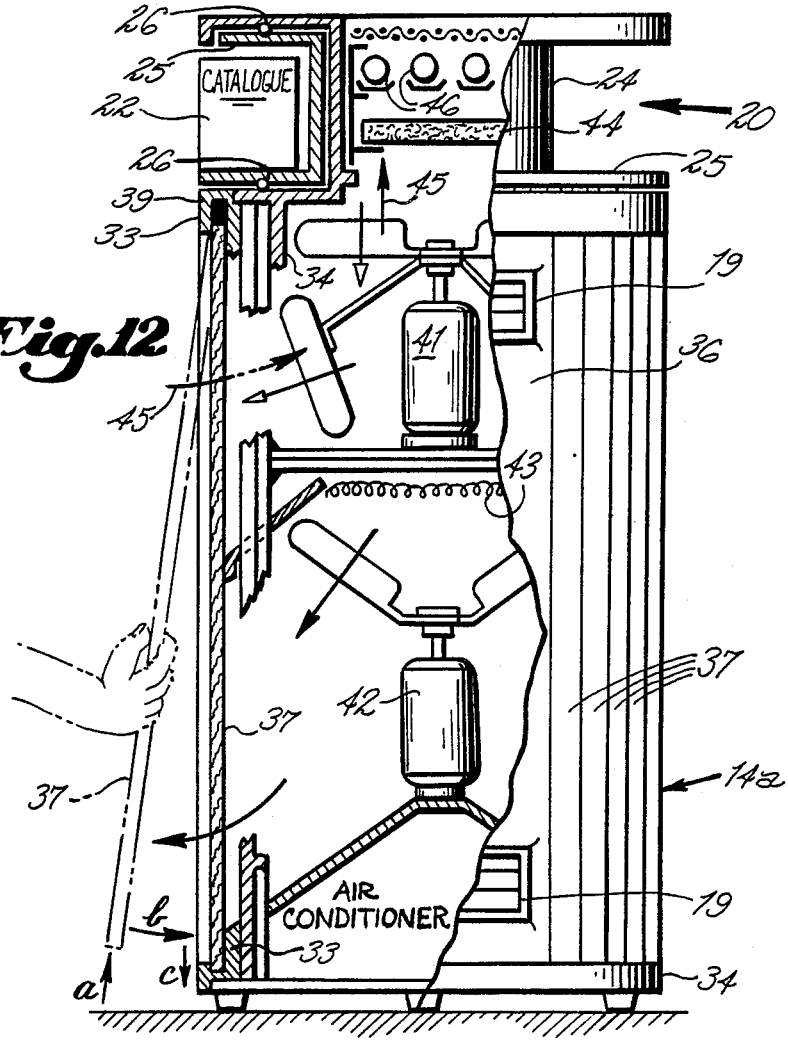
Fig. 12
Fig. 22
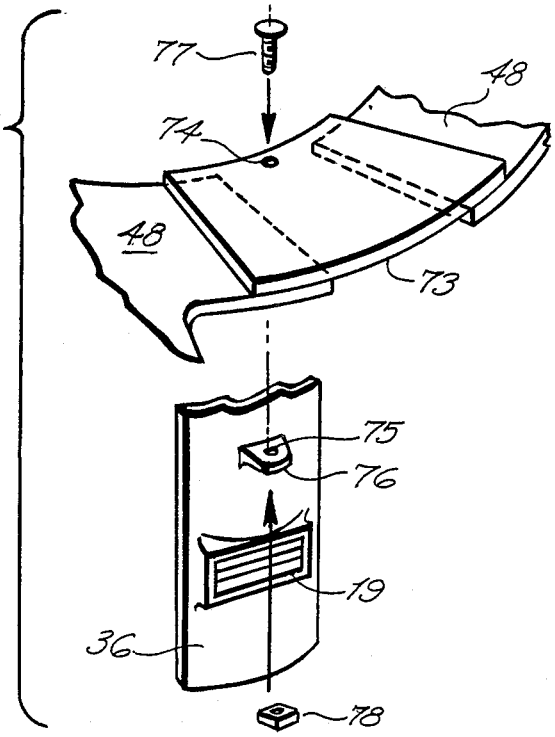
Fig. 21
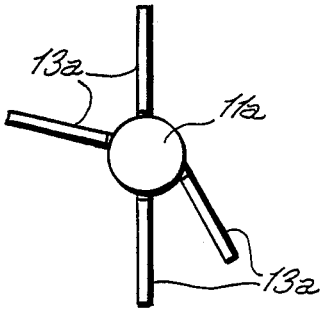

MODULAR WORK STATION

BACKGROUND OF THE INVENTION

1. Field of the Invention:

This invention relates generally to office furniture. More specifically it relates to free-standing office furniture units designed for grouping of workers doing interrelated tasks, so to be nearby yet personally separated.

2. Prior Art:

It is well known that in a very large room holding many office workers, the modern trend is to cluster them into spaced apart groups instead of in rows of desks, for less monotony and other advantages such as improved mobility in efficient use of existing work space and more effective work flow in the use of available technical equipment. Some of these units provide air circulation and temperature individually controlled for each occupant. While the units have numerous pleasing features, there is one popular model thereof that is made with a specific number of individual work areas clustered around a climate-control unit that serves these surrounding areas, and which hereinafter in this paper shall be termed as a central "weather station" structure.

This unit is constructed as a rigid, single unitary structure so that its fixed number of work areas cannot be altered. This becomes objectionable to a company who after installing many units of a particular size, such as for example a five-work unit, and later wishes change to a three- or four-work area unit as well as some other designed room arrangement for offering flexibility in the improvement of carrying out daily business tasks. This situation is accordingly in need of an improvement.

SUMMARY OF THE INVENTION

Accordingly, it is a principal object of the present invention to provide an improved modular work station which may be easily and quickly converted between having either three, four or five work areas, as wished at any time.

Another object is to provide an improved modular work station which is flexible and selectively extendable in floor plan design and in contour shape, so that a work area may be more convenient for accomodating either a particular size and shape of office machine equipment or else more personnel therein, who may be seated in either chairs or wheelchairs or else standing while working at their station as wished.

Yet another object is to provide an improved modular work station that incorporates hidden air ductwork extending throughout its components so that any heat that may be generated by machines placed anywhere in the work areas can be exhausted outward therefrom while air conditioned or fresh air may be blown thereinto for comfort of personnel.

Yet a further object is to provide an improved modular work station that includes a self-contained material transmittal system between the work areas.

Yet another further object is to provide an improved modular work station that includes structures which make it easier for handicapped persons to also work therein.

These and other objects will be readily evident upon a study of the following specification and the accompanying drawings.

BRIEF DESCRIPTION OF THE DRAWING FIGURES

FIG. 1 s a top perspective view of one design of the invention.

FIG. 12 is a side-elevational view of the weather station shown partly in cross section as viewed on line 12—12 of FIG. 11.

Figure 18:
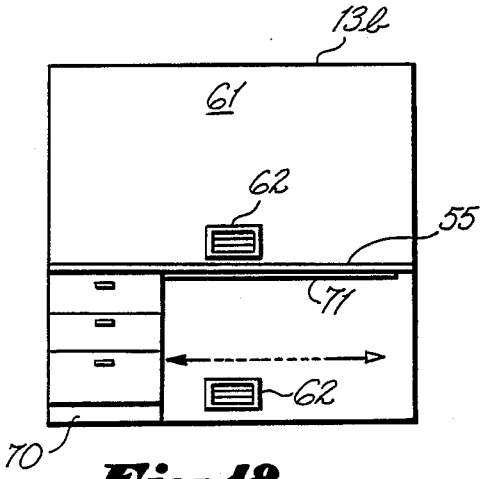

FIG. 18 front-elevational view of the partition and desk unit shown in 17, and illustrated in another adjusted position.

Figure 19:
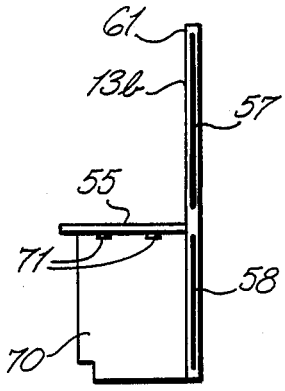

FIG. 19 is an end-elevational view thereof.

Figure 17:
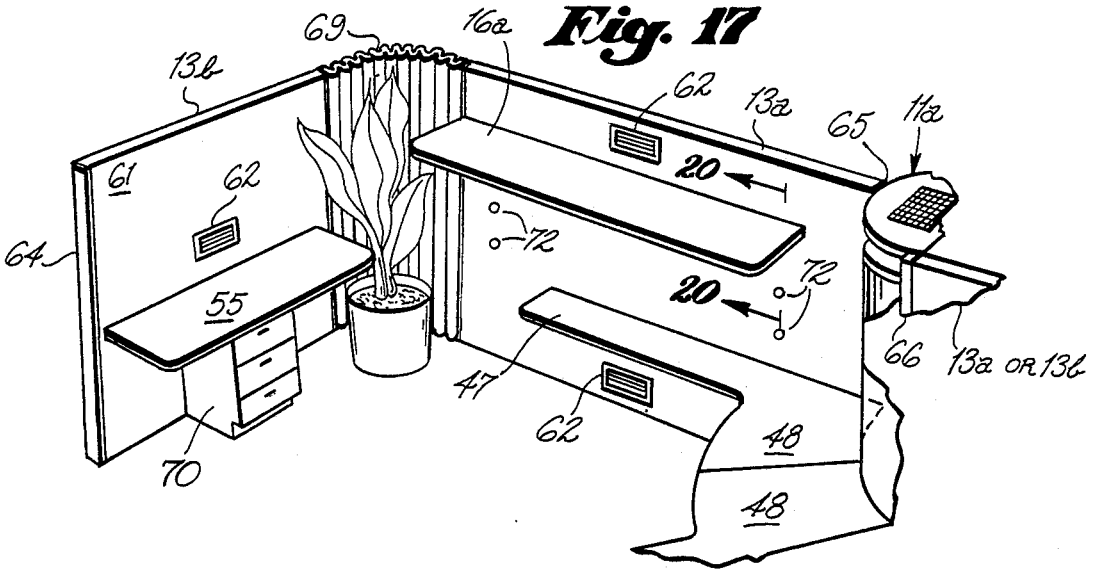
FIG. 17 is a perspective view of another example thereof.
Figure 20:
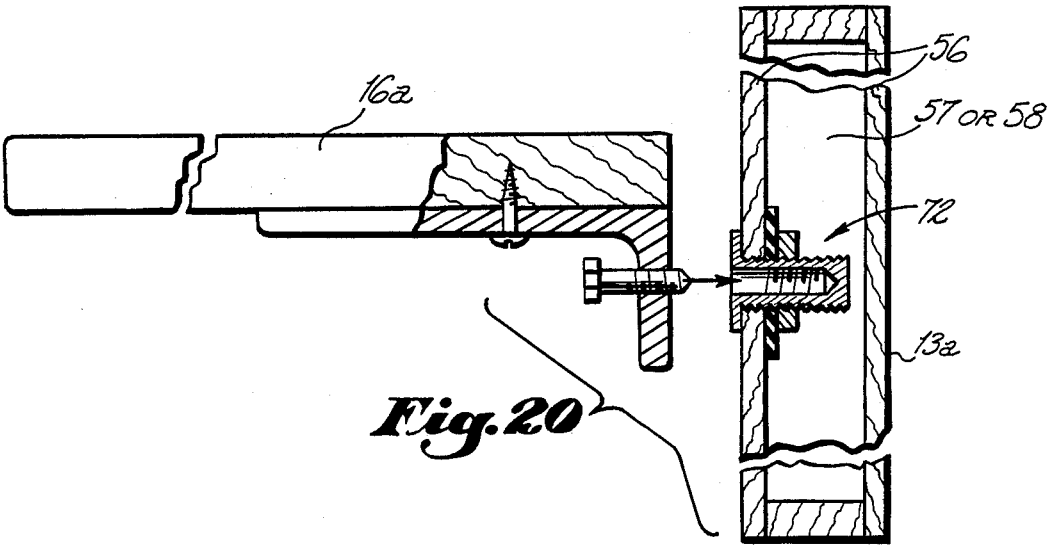

FIG. 20 is an enlarged cross-sectional view taken on line 20—20 of FIG. 17.

FIG. 21 is a top plan view of yet another design of module able to have bays of any dissimilar size.

FIG. 22 is a perspective view of a modified design of panel upon which a computer or other office machine may be rested.

Figure 23:
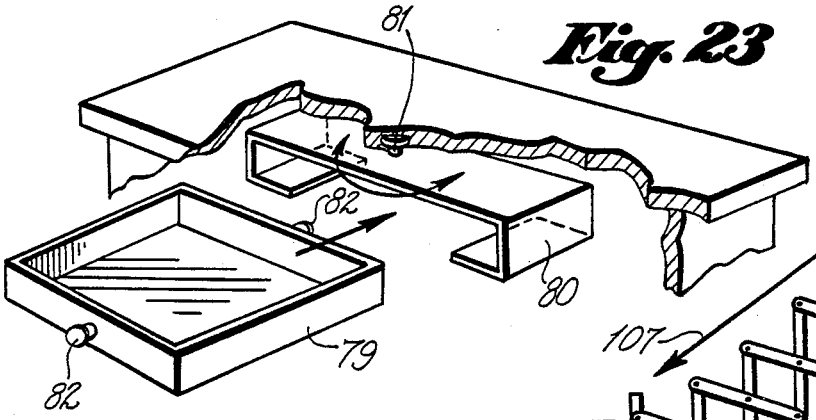

FIG. 23 is a fragmentary perspective view of a desk that includes a drawer which additionally is rotatable.

Figure 24:
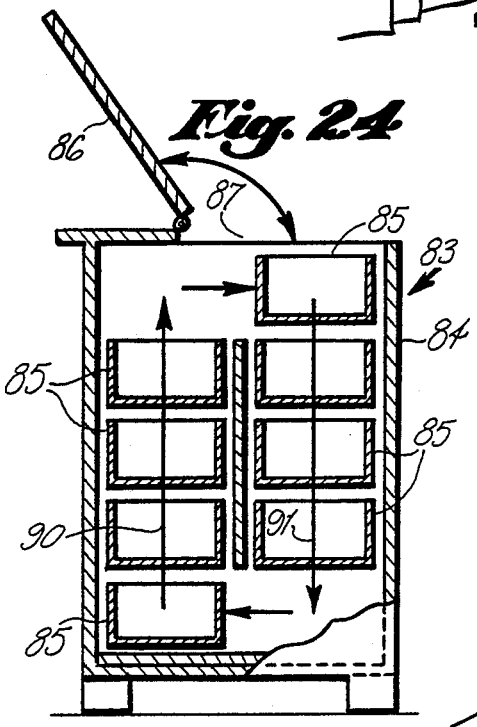

FIG. 24 is an end elevational view of another desk shown partly in cross section, and having drawers that are adjustable in vertical location.

Figure 25:
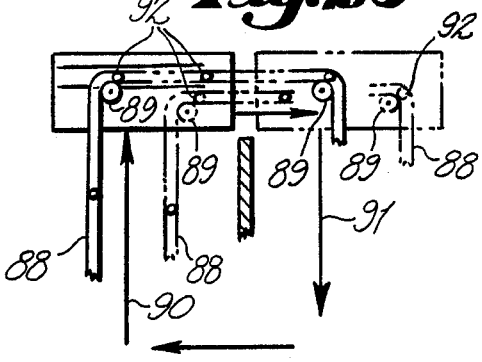

FIG. 25 is a fragmentary diagram of a drive mechanism thereof.

Figure 26:
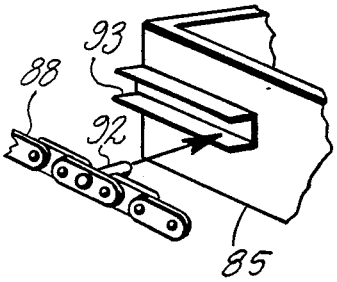

FIG. 26 is a fragmentary detail thereof, shown in perspective.

Figure 27:
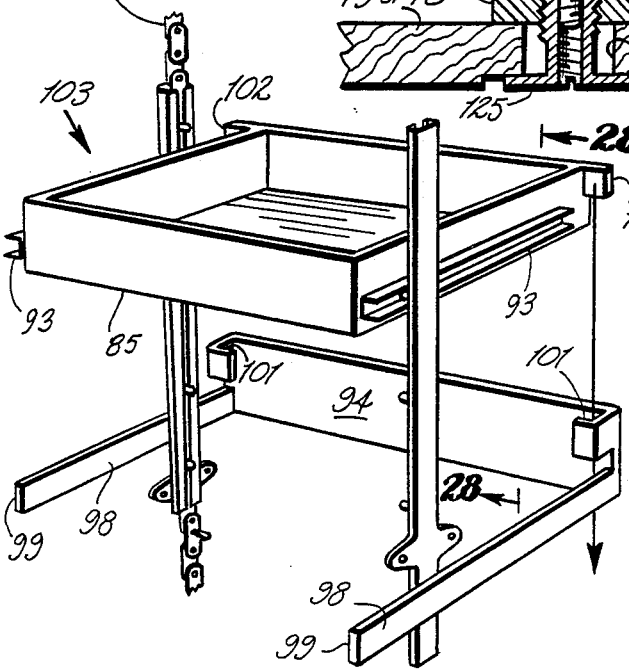

FIG. 27 is a fragmentary perspective use of an additional design incorporated in the desk shown in FIG. 24.

Figure 28:
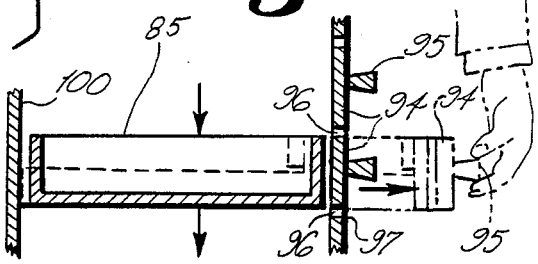

FIG. 28 a cross-sectional view taken on line 28—28 of FIG. 27.

Figure 29:
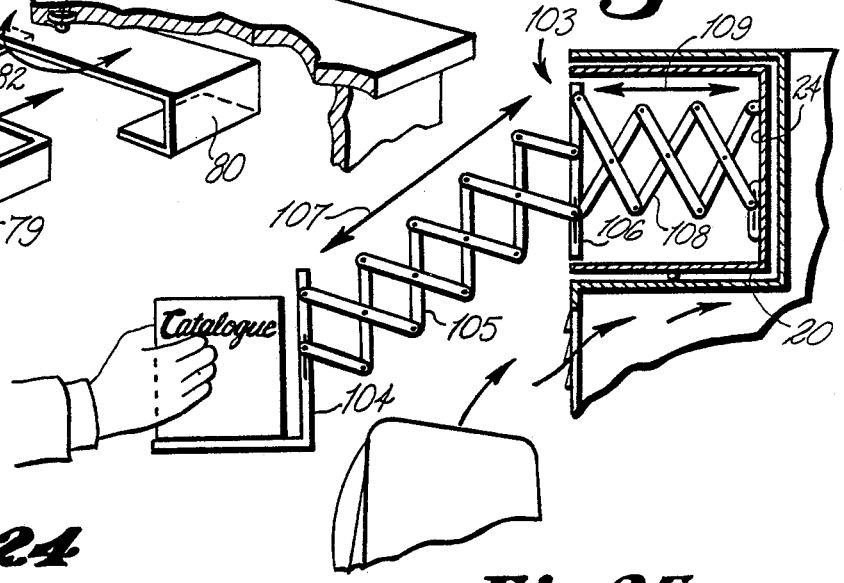

FIG. 29 is a diagrammatic side view of a mechanism for bringing within easy reach some of the items stored on the rotary shelf; the mechanism being shown in extended position.

Figure 30:
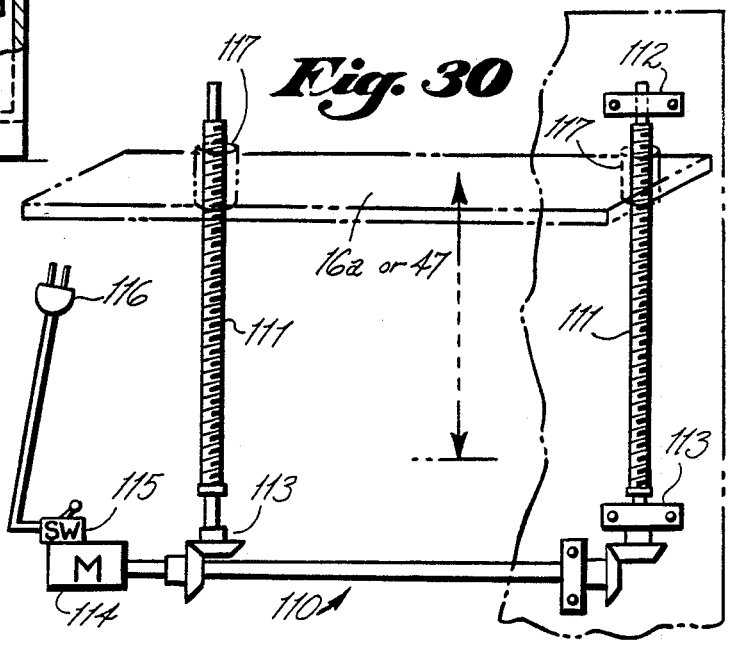

FIG. 30 is a diagrammatic view of a mechanism for adjusting a desk top or shelf vertically.

Figure 31:
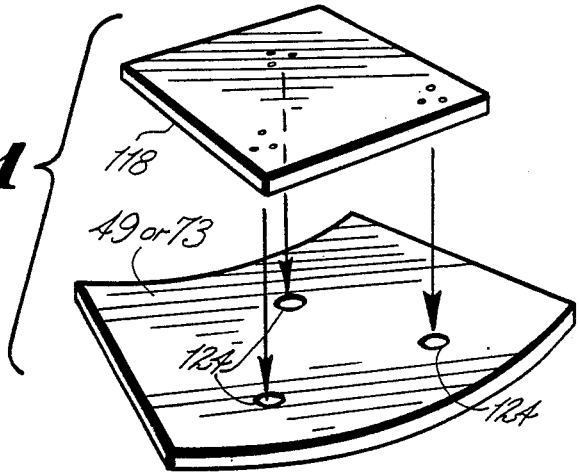

FIG. 31 is a perspective view of an adjustable computer supporting plate in relation to an insertion panel.

Figure 32:
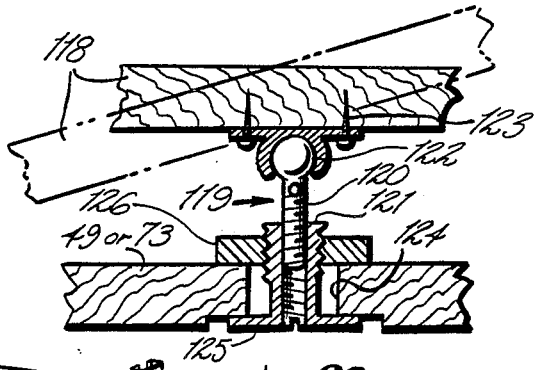

FIG. 32 an enlarged cross-sectional view of one of the adjustable bolts secured therebetween.

DETAILED DESCRIPTION OF PREFERRED EMBODIMENTS

Figure 1:
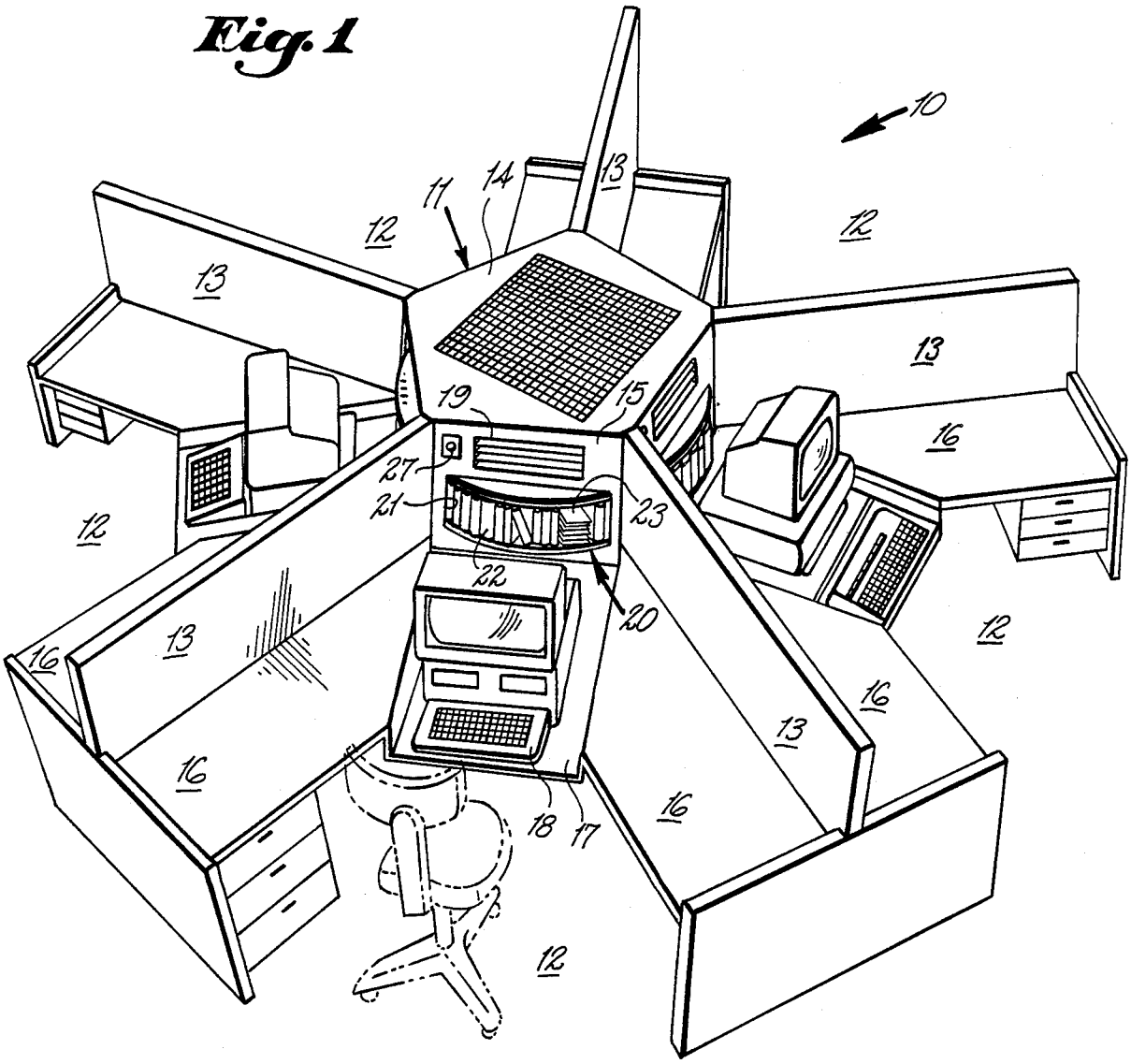
Figure 2:
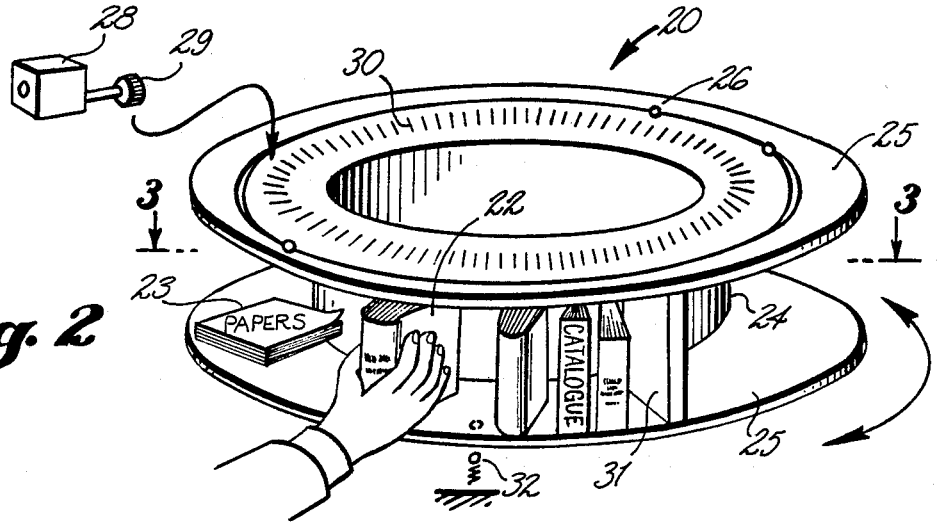
FIG. 2 is an enlarged perspective view of a rotatable shelf used in the shown in FIG. 1.
Figure 3:
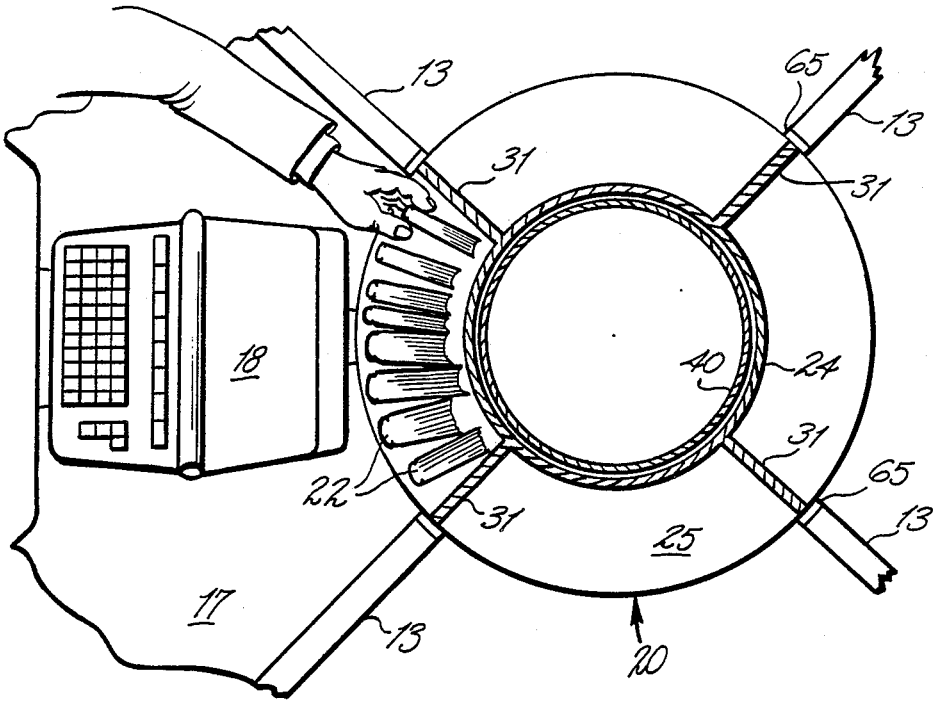
FIG. 3 is a cross-sectional view taken on line 3—3 of FIG. 2.

Reference is now made to the drawings in greater detail, and more particularly to FIGS. 1 to 3 thereof at this time, wherein there is one design of work station module 10 according to the present invention that includes a central vertical conduit which could possibly be termed a controlled weather station 11 because it provides temperature variations in circulated air as well as light and possibly the addition of air conditioning; the central weather station being surrounded by a plurality of work areas comprising bays 12 formed between vertical partitions 13 extending radially from the weather station. In this design, the weather station comprises an upright housing 14 that contains equipment for controlled air circulation and temperature variations to each of the bays; the housing having a same number of side walls as the number of bays so as to present a flat side wall 15 to each one of the bays, and each of these walls including ventilation means communicating between the interior of the housing and the bay. Accordingly in this design, the central housing and the partitions may preferably be made as a rigid singular unit. A work desk 16 having a desk top at a convenient height for a seated person may be attached to each side of the partition while a lower height platform 17 projects from the wall 15 serving to support an electronic computer 18 or other typical office machine which may generate some heat in operation, the heated air being dispensed outward from the bay through the upper vent 19 so to provide a comfortable temperature for a person working in the bay. Another air vent below the platform can serve to dispense heated air from the housing to the vicinity of a person's feet, whenever so wished. The above described construction is already known in the modular work station field.

However, in the present invention, a rotatable circular shelf 20 is additionally included around the housing, and each wall 15 has an opening 21 through which a periphery of the shelf projects for persons in every bay to have access to any portion of the shelf when rotated to the opening. The shelf serves to hold manuals, catalogs 22 and the like used by the persons in the various bays and also for transmitting papers 23 or other materials between the bays without need of persons walking around the module so to deliver them. The shelf comprises a circular back wall 24 with upper and lower outward flanges 25, and may be supported rotatably free by bearings 26 therebetween and the housing. The shelf may be electrically operated to turn in either direction by a pushbutton switch 27 located on each wall 15; the switches operating a motor 28 turning a gear 29 traveling in a toothed track 30 on one of the flanges. Partitions 31 between the flanges serve to align with the partitions 13 when the shelf is stationary so to prevent controlled air within one bay to leak into a next adjacent bay; a detent 32 between the shelf and housing tending to stop the shelf rotation when the partitions 13 and 31 align, as shown in FIG. 3. The partitions 31 could be frictionally held between the two flanges 25 so to be removable for relocating, depending on positions of partitions 13 in any change of the module between three to five bays (as mentioned in the following paragraph).

Figure 4:
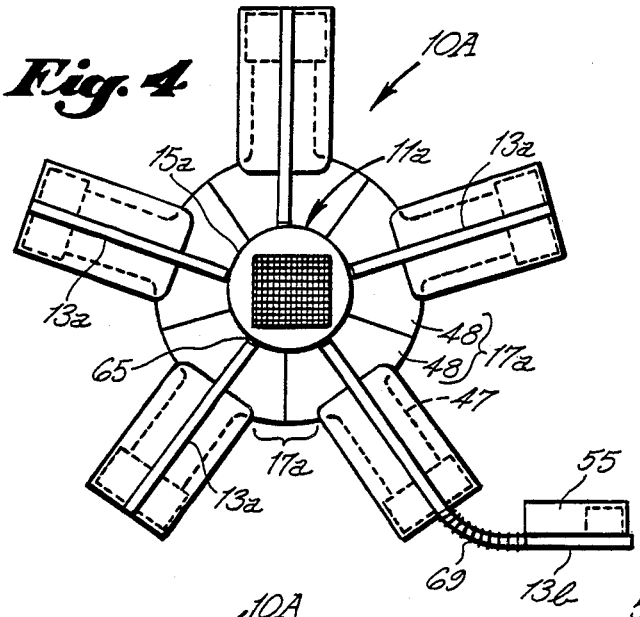
FIG. 4 is a top plan view of the modular work station shown in FIG. 1, but showing a circular central weather station instead a five-sided one.
Figure 5:
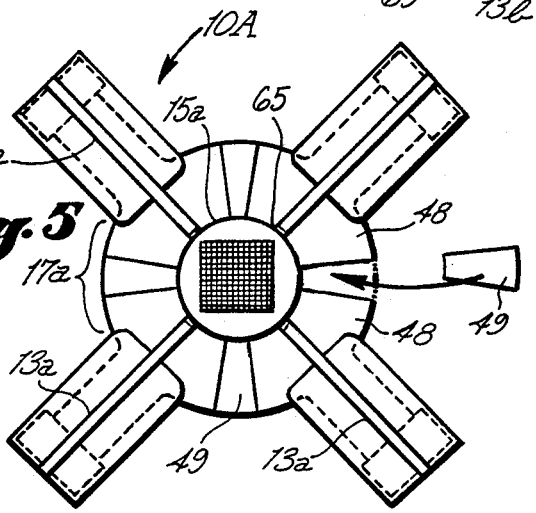
FIG. 5 is a view similar to FIG. 4 showing the modular work station to four work areas instead of five.
Figure 6:
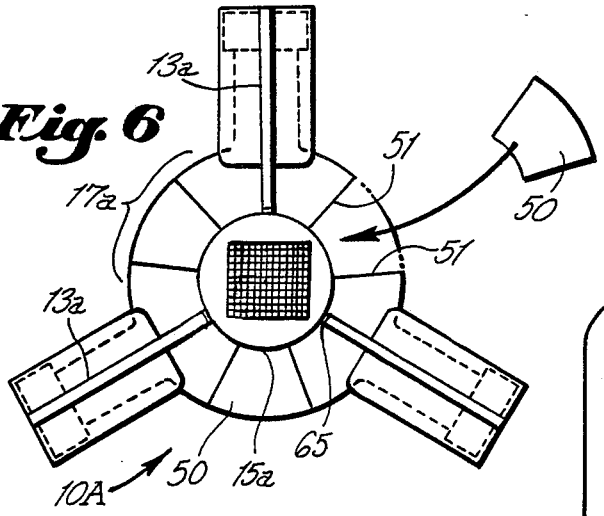
FIG. 6 is another similar view thereof shown converted to three work areas.
Figure 11:
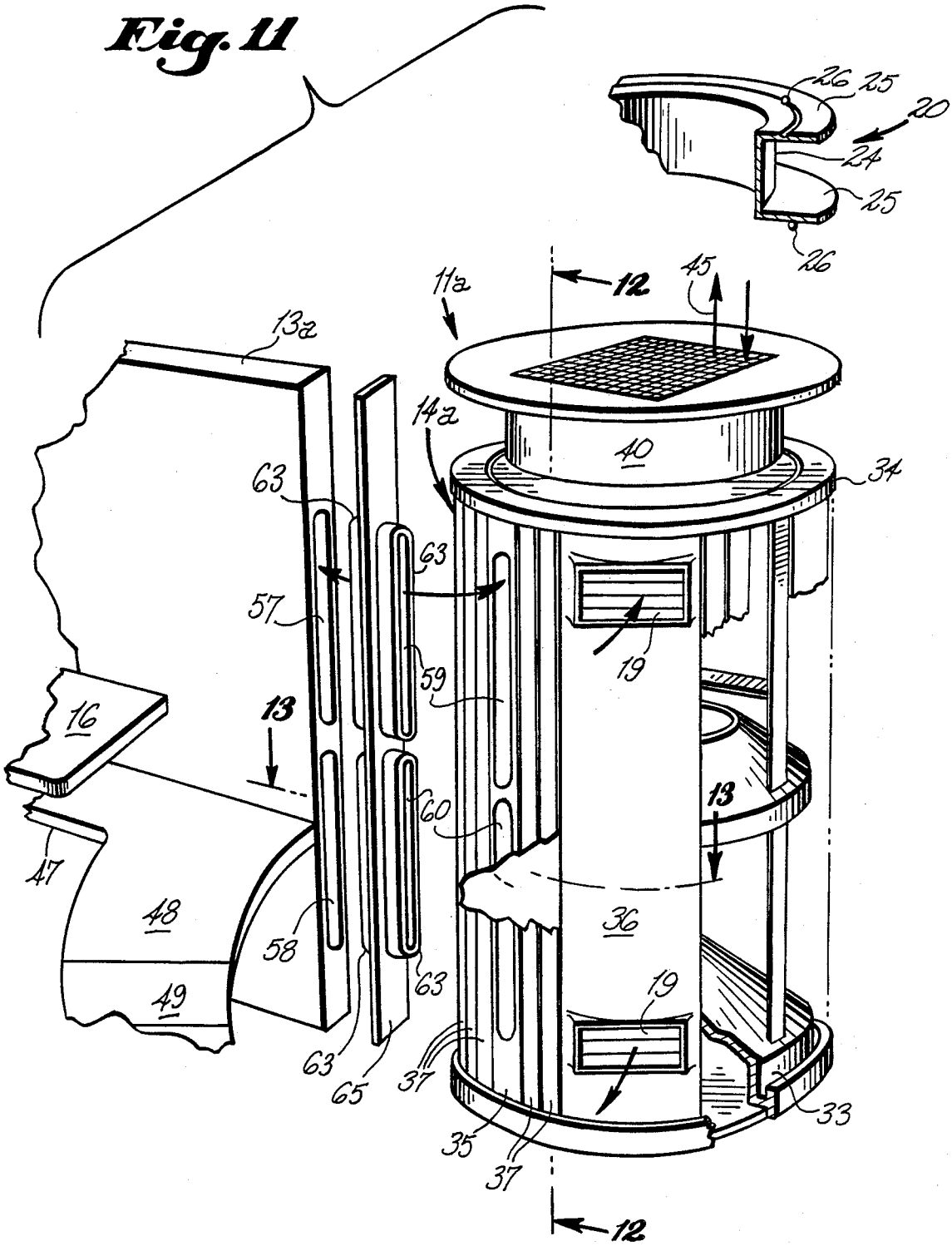
FIG. 11 is an enlarged perspective view of the circular weather station housing shown partly broken away to illustrate its interior construction.
Figure 13:
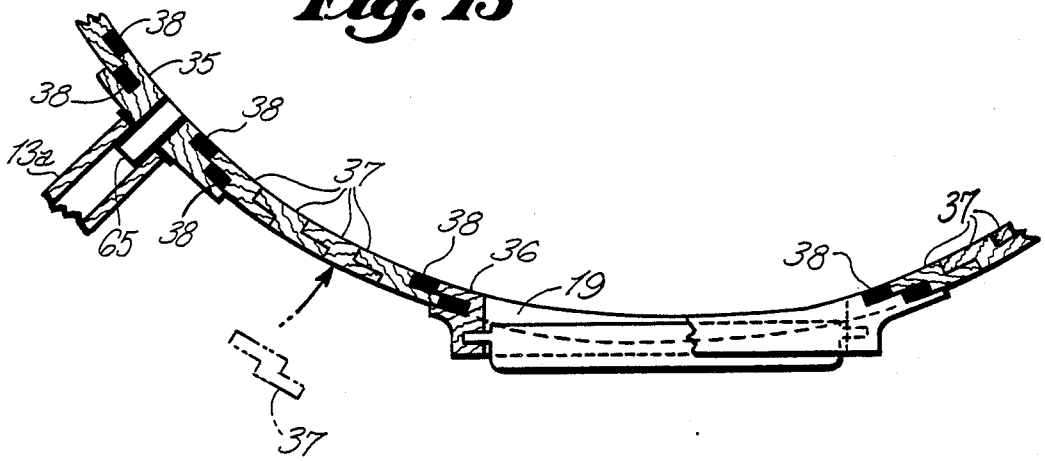
FIG. 13 is an enlarged cross-sectional view taken on line 13—13 of FIG. 11.
Figure 14:
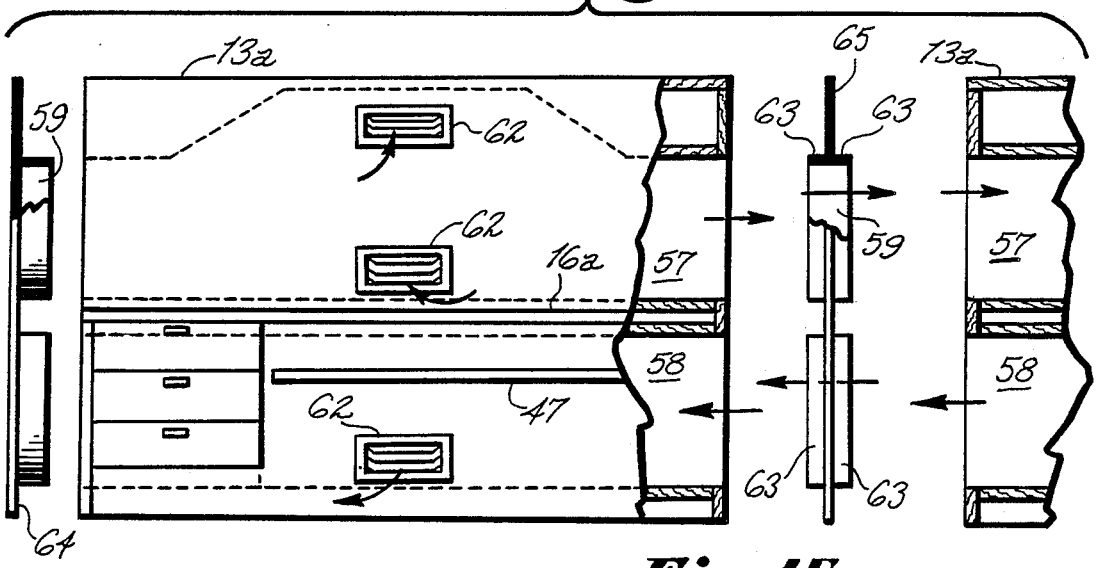
FIG. 14 is an exploded side-elevational view, shown partly in cross section, illustrating one of the work area partitions and its connecting structures.

A preferred design of work station module 10A, shown in FIGS. 4, 5 and 6, differs from the above described module 10 by being additionally readily convertible to either three, four, or five bays, as wished. This is accomplished by making the partitions 13*a* to be detachably attachable to the housing. In order to eliminate the problem of making the housing changeably five-sided, square or triangular so to form a flat wall 15 for this purpose, the housing 14*a* of weather station 11*a* is made round instead, and the walls 15*a* arcuate. The use of more or less partitions 13*a* results in walls 15*a* being variable in length, and this is overcome by each wall 15*a* being composed of several components fitted together as needed. Accordingly, as shown in FIGS. 11, 12 and 13, a set of wall components for the housing could comprise a number of vertical narrow slats fitted in upper and lower grooves 33 formed around a housing frame 34. This set of slats may be made to include six slats 35 used for anchoring the ends of partitions 13*a* to the housing, six slats 36 having air vents 19, and a quantity of overlapping plain slats 37 to close the spaces therebetween, as needed. Resilient rubber pads 38 shown in FIG. 13 may be attached along side edges of the slats 35 and 36 so to fill any left over space and prevent air leaks through the housing wall. An upper conical baffle and a lower conical baffle inside the housing direct air from fans 41 or 42 toward the upper and lower vents 19 and also toward other vents that shall be mentioned hereinafter. A resilient rubber pad 39 nested inside the upper groove 33 serve to prevent air leaks around a top of the assembled slats. As shown, by phantom lines in FIG. 12, a slat is easily installed in the frame by simply inserting the slat upper end into the upper groove, then squeezing it up against the pad 39 sufficiently so a lower end of the slat can swing into the lower groove, (as indicated by subsequent steps a, b and c).

The housing includes a narrow neck 40 around which the shelf rotates; the neck being located either at an upper end of the housing, as shown in FIGS. 11 and 12 or else lower down, as shown in FIG. 1. The equipment inside the housing includes an upper two-directional fan 41, a lower downwardly blowing fan 42, an electric heater 43, air filter 44 and possibly an air conditioning unit, as well, that is housed within the space underneath the lower conical baffle.

The fan 41 serves to exhaust heated air 45 from equipment 18 through upper vent 19 into the housing and then upward out a screened top opening of the housing. Fan 42 draws the heated air from the equipment or from the top opening downward past the heater 43 (which may be turned on or off) and then out the lower vent 19 toward a person's feet. All vents are louvered so to be selectively closed or opened to control the air path as wished. Lamps 46 within the top opening serve to floodlight a room ceiling so to provide indirect lighting for occupants in the module. This above described equipment used inside the weather station is known in the particular field so is not here in detail regarded to be new.

Figure 7:
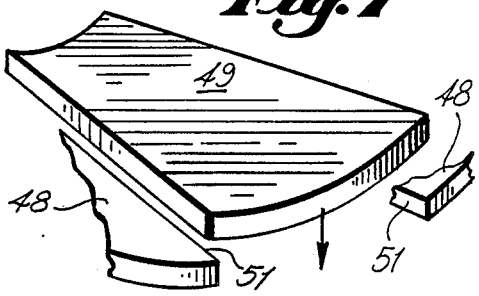
FIG. 7 is an enlarged perspective view of the insertion panel illustrated in FIG. 5.
Figure 8:
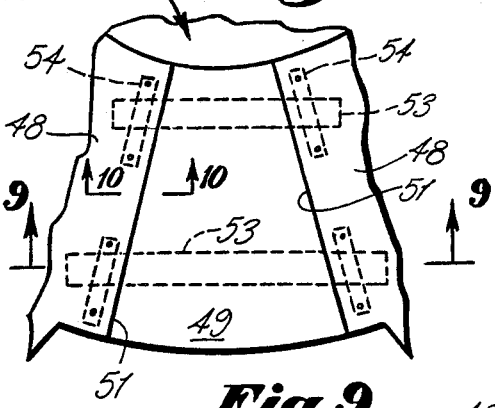
FIG. 8 is a top plan view thereof showing supportive bracing therefor.
Figure 9:
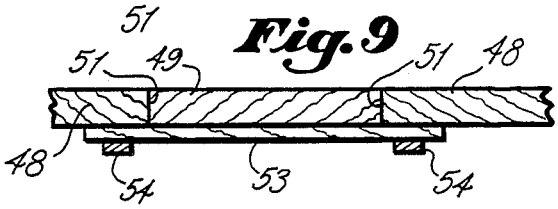
FIG. 9 is a cross-sectional view taken on line 9—9 of FIG. 8
Figure 10:
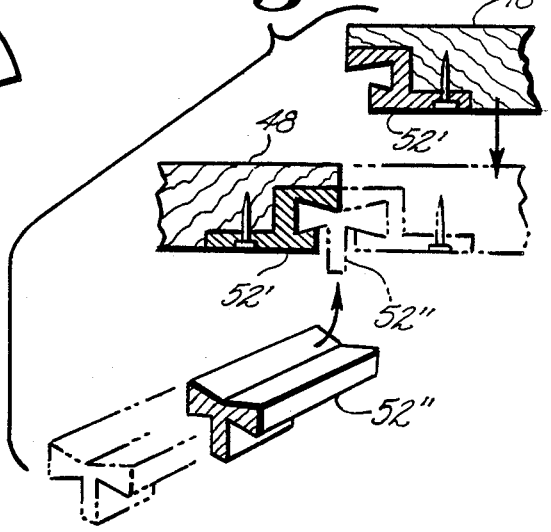
FIG. 10 is a greatly enlarged cross-sectional view taken on line 10—10 of FIG. 8 showing another design thereof that also includes interfit elements.

Referring now to FIGS. 4 to 10 ,the above described machine equipment platform 17 of module 10 is here structurally modified in module 10A so to comprise a low storage shelf 47 attached alongside each partition 13*a* and which includes a sideward extension 48 adjacent the weather station so that in each bay the two extensions adjacent each other together form an equipment platform 17*a*. When the module is set up for maximum number of bays, as shown in FIG. 4, the extensions abut each other. However, when the module is set up for less bays the partitions 13*a* are farther apart, as shown in FIGS. 5 and 6, so that either a narrow panel 49 or a wide panel 50 is inserted between the extensions so to fill the space and complete the platform 17*a*. Opposite side edges of the panel and the edge 51 of each extension are made plain so to simply abut against each other as shown in FIGS. 7 to 9 or else each additionally includes a groove element 52' that can be locked together by sliding a double-tongued element 52" therebetween as shown in FIG. 10 so to form an interlocked flush-top surface of the platform and the adjacent extensions. Removable cross braces 53 between brackets 54 on the underside of the extensions 48 strengthen the panel for support of heavy office equipment 18.

Figure 16:
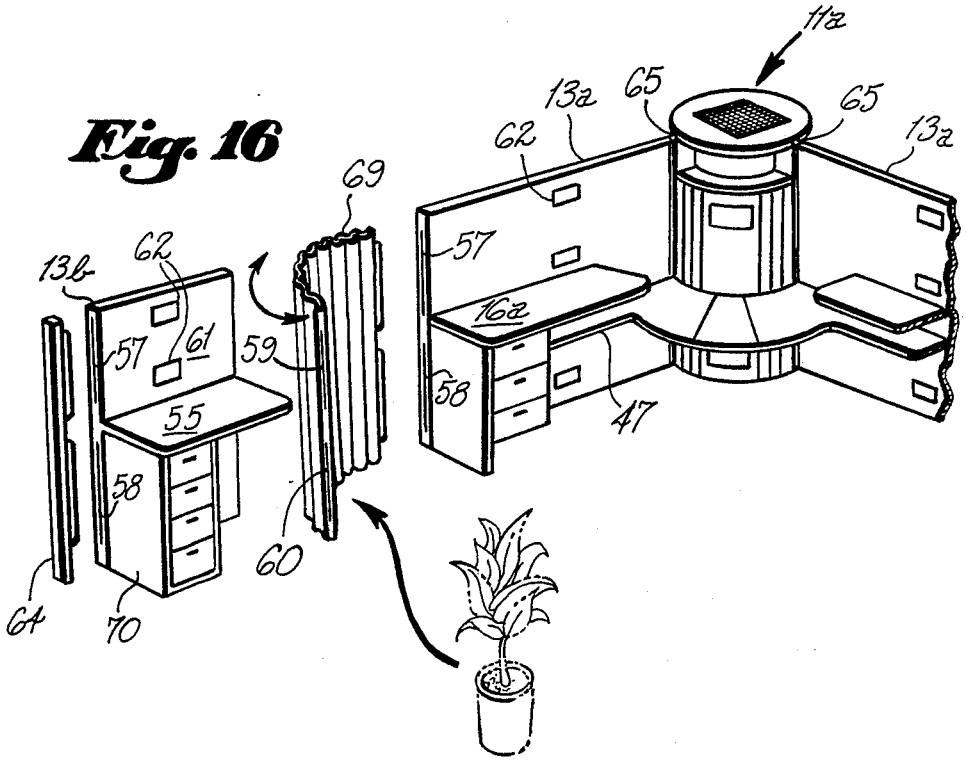
FIG. 16 is a perspective view illustrating one example of module assembly variation.
Figure 15:
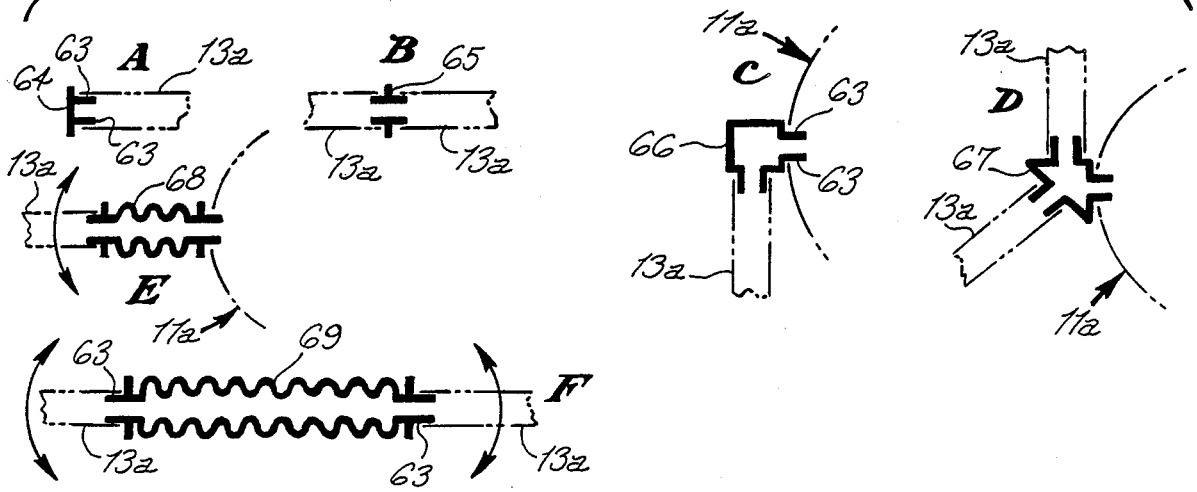
FIG. 15 illustrates transverse cross-sectional views of an assortment of connecting structures.

Different bay layouts, such as suggested in FIGS. 4, 16 and 17, are made possible by adding an extra desk 55 or other office furniture such as a bookcase or the like to the module, also by making the partitions 13*a* to be detachable from the weather station 11*a* and then by use of different shaped connectors as suggested in FIG. 15, to assemble the module components into various floor plan arrangements so as to accomodate more personnel or larger office machines. The connectors of FIGS. 15*c* or 15*d* permit a partition to be connected tangentially or angularly respective to the weather station, instead only radially as shown in FIG. 1.

In the present invention, the partitions 13*a* are made hollow between spaced-apart side panels 56 so to form narrow air ducts 57 and 58 therethrough. The various connectors and the slats 35 are likewise made with air passages 59 and 60 therethrough so that air may circulate between the interior of the weather station and even a remotely located partition 13*b* which possibly serves as a desk back wall 61 having louver-controlled air vents 62 for worker comfort. Similar air vents 62 are along the partition 13*a* for workers at desks 16*a* along the partition. Fan 41 moves air through ducts 57 and fan 42 moves air through ducts 58.

The connectors are molded of resilient plastic or rubber and include lips 63 that fit snuggly into the open ends of the ducts for making air-tight connections between the module components. FIG. 15A shows a connector 64 that plugs up an open end of a duct; 15B shows a connector 65 for making a straight line connection; 15C shows a connector 66 for a right angle connection; 15D a connector 67 for multiple diagonal angle connection; 15E a short, accordian-pleated connector 68 that flexes right or left for a curved or straight line connection; and 15F a longer similar accordian-pleated connector 69. Of course other connector designs may be made.

The desk 55 shown in FIGS. 16 to 19 includes a pedestal 70 slidable along dove-tailed rails 71 on an underside of the desk top for selected positioning on a floor; the desk top being affixed to the back wall 61.

Alternately the desk 16*a* may comprise only a desk top panel, as shown in FIG. 17, so to be selectively supported in a raised position by a mechanism shown in FIG. 30, if a person chooses to stand while working from it. Otherwise the panel may be supported from selected mounts 72 installed on the partition 12*a*, as shown in FIG. 20. Likewise desk 55 can be alternately made without the dove-tailed rails, so its desk top may be similarly raised.

In yet another design of the invention shown in FIGS. 21 and 22, the module may be set up so that the bays are not limited to all necessarily being a same size as shown in the examples illustrated in FIGS. 4 to 6. Instead, some partitions 13*a* may be made closer or farther apart from each other by having dissimilar number of slats 37 therebetween. This of course results in endless variation of the space between extension edges 51 so instead fitting a panel 49 or 50 therebetween, a larger panel 73 is used that rests upon the extensions and bridges the space; the panel being of sufficient size to fit under the entire machine 18, yet also fits into either a narrower bay (having minimum space to bridge), or a wider bay (having a maximum space to bridge). The panel is rigidly secured from sliding by aligning an opening 74 in the panel with an opening 75 in a bracket 76 affixed on an outer side of the slat 36, and a bolt 77 being inserted through the openings and fitted with a nut 78.

As shown in FIGS. 23 to 30, the present invention may be made to additionally include various means for vertical adjustability, so to be helpful to workers who are physically not strong or are handicapped, possibly even confined to a wheel chair, so cannot stand up or bend down to reach for things, nor have sufficient strength for pushing, pulling or lifting.

Usually, when a person seated at a desk, needs reaching far inside a lap drawer located in front of him, the person is obliged to either move his chair rearwardly or at least shift himself farther back in the chair to make space for the drawer being sufficiently slided out. Such maneuver may be objectionable to some handicapped. Accordingly the desk in FIG. 23 eliminates this problem. A drawer 79 is conventionally slideable forward for access thereinto. However in this design, it is not necessary to pull the drawer far out in order to reach inside its rear area. The drawer is slideably supported in a channel-shaped bracket 80 that is supported from an underside of the desk top by means of a post 81 about which the bracket is pivotable so that either opposite end of the drawer can be moved to a front side of the desk. The drawer is slideable outwards from either opposite end of the brackets, so is provided with a pull knob 82 on each end. Thus when the drawer is turned one-half way around, access into its rear is easily accomplished without pulling the drawer far out. A detent (not shown) may serve to normally maintain the bracket in proper forwardly or rearwardly turned positions.

Referring now to FIGS. 24 to 26, another design 83 of desk is shown that includes a desk pedestal 84 stacked with drawers 85 from floor to desk top, each one of which is accessible to a person seated at the desk without need to bend down for pulling or pushing the lower ones thereof, such as in a conventional desk. In this design, the desk top includes an upwardly pivotable desk top portion 86 in order to form an access opening 87 to the uppermost drawer. All of the drawers are supported between a pair of endless chains 88 that travel along an upright, generally circular path so that the drawers are carried on this course similarily to chairs on a ferris wheel, so that in succession each is brought into the raised top position accessible within the opening 87. Each chair travels around a set of sprockets 89 powered by a pushbutton controlled electric motor. The travel path accordingly includes a stack of drawers 90 traveling upward and another stack of drawers 91 traveling downward. When a downward traveling drawer reaches a lowermost position of the stack 91, an electric switch is automatically tripped causing a pivoting arm (not shown) to push this lowermost drawer horizontally into the lowermost position of the drawer stack 90. At a same time, a similar mechanism shifts the uppermost drawer of the stack 90 to the uppermost position of the stack 91 for being accessible to the person. This shifting permits many shallow drawers being closely stacked one upon another while each drawer, being made long, must travel a long horizontal distance, and drawers within the stacks travel only a short distance within the same time limit, as the chain travels. Each chain has a plurality of equally spaced-apart projections 92 extending sidewardly therefrom, and each drawer has a horizontal channel 93 on each of its opposite sides; each channel sliding off several of the supporting projections and onto another like number of vacant projections during any drawer horizontal shift. During vertical travel in the stacks, the drawers are carried by a single projection in each channel groove.

FIG. 24 shows that the drawers accordingly do not slide out a front side of the desk, resulting in a desk of novel design. However, in another design shown in FIGS. 27 and 28, the drawers are made not only accessible from the top opening but also conventionally through the desk front wall. A drawer false front panel 94 having a pull handle 95 slides into each opening 96 of the desk front wall 97, and is affixed to a pair of bars 98 slideable in tracks mounted on inner sides of the desk pedestal side walls; the ends 99 of the bars abutting against partition 100 when the false front panel seats within the opening. A vertical corridor 101 formed at each end of the false front panel serve to slideably receive a rigid tab 102 affixed on each end of the drawer front wall. Thus when the drawer is descended in the stack 91, the tabs can be captured in the corridor 101, so when handle 95 is pulled, the drawer is slided out.

Referring now to FIG. 29, a mechanism 103 added to the rotatable shelf 20 serves to lower and bring forwardly a portion of the shelf content for purpose of easy reach. A carrier 104, upon which catalogs and the like are placed, is stored within the shelf space; the carrier being moveable from the shelf as wished and then returned. The carrier is arcuate lengthwise so to fit the shelf and its length allows it fit in a minimum width bay. The mechanism 103 includes a pair of parallel, spaced-apart lazy tongs 105 between the carrier and a frame 106 for moving the carrier angularly vertically (as indicated by double-headed arrow 107) and another pair of parallel, spaced-apart lazy tongs 108 between the frame and a back wall 24 of the rotary shelf 20 so to move the frame and carrier horizontally out of the shelf (as indicated by the double-headed arrow 109); the two pairs of lazy tongs being necessitated because the carrier must be outside of the shelf space in order to move angularly vertically.

In stored position, all the lazy tongs are collapsed flat so the entire mechanism rests against the back wall. To extend the mechanism from the stored position, the lazy tongs 108 are extended first to the position shown in FIG. 29, and then the lazy tongs 105 are automatically extended to the position also shown. To return the carrier on the shelf, the procedure is in reverse. The initial tong movement for either extending or retracting operation is actuated by a manually operated pushbutton switch and the final tong movement is then automatically actuated by a switch on the frame 106.

In FIG. 30 a mechanism 110, located inside the partition, is shown for vertically adjusting a shelf or desk top for either a seated or standing worker or accomodating any height most comfortable to a handicapped or older worker. A pair of spaced-apart screw jacks 111 supported in brackets 112 mounted on partition **13*a* are rotated, through gearing 113, from a two-directional motor 114 in electric circuit with a switch 115 and power supply connection plug 116; the screw jacks engaging threaded sleeves 117** mounted on a rear edge of the shelf or desk top. Alternately, a hydraulic mechanism may be used instead.

In FIGS. 31 and 32 means are shown for an office machine 18 being tilted at a small desired angle so to benefit certain handicapped persons having a visual angular imbalance. The office equipment is mounted upon a plate 118 that is selectively tilted in universal direction by being supported upon three telescopic posts 119 between the plate and panels 49 or 73. Each post comprises an adjustable bolt 120 in a threaded sleeve 121; the bolt head having a universal joint 122 and being fastened to an underside of the plate by nails 123. The sleeve is inserted through an oversized hole 124 in the panel for lateral adjustment therein and is rigidly secured to the panel by grasping it between an enlarged flange 125 on its one end and a nut 126 threaded on its other end.

While various changes may be made in the detail construction, it is understood that such changes will be within the spirit and scope of the present invention, as is defined by the appended claims.

What I claim as new, is:

1. An improved modular work station, comprising in combination, a circular, central weather station and a plurality of work areas surrounding said weather station; said weather station comprising an upright conduit formed by a circular side wall enclosing a central space containing fans, a heater and an air conditioner for circulation of air into said work areas; said work areas being comprised by a plurality of spaced-apart vertical partitions each of which is detachably attached at its one end to said conduit side wall so to form bays therebetween defining said work areas, and attachment means between said wall and partitions for selectively extending said partitions from said wall into any direction; said conduit side wall comprising a plurality of vertical slats removably supported in a circular frame for adjustable positioning so to form arcuate wall portions of varied lengths between said partitions and thus create varied sizes of said bays.

2. The combination as set forth in claim 1, wherein each said partition includes a thin upper and lower air duct formed between opposite flat side walls of said partition, and a duct opening thereto at both opposite ends of said partition.

3. The combination as set forth in claim 2, wherein an air vent is at a top of said conduit for communication with an atmosphere thereabove, a plurality of air vents are through said conduit side wall for communication with said ducts of said partitions, and air vents are on said partition side walls for communication with said bays.

4. The combination as set forth in claim 3, wherein said module additionally includes a plurality of extra said partitions and attachment means between ends of said extra partitions and the first said partitions, said extra partitions also including air ducts therewithin and vents on side walls thereof for air circulation between said conduit and a further away area of said bays.

5. The combination as set forth in claim 4, wherein said attachment means comprises a connector made of flexible material and having an upper and lower opening therethrough for said air circulation.

6. The combination as set forth in claim 5, wherein a desk top on each side of the first said panel is supported height-adjustably upon a pair of spaced-apart, vertical screw jacks rotatably driven by a motor for use by either a seated or standing person; and a lower supply shelf attached alongside said partition includes a shelf extension at its one end which together with a like extension of a like supply shelf along a partition on an opposite side of a same bay together form a platform to support an office machine thereupon.

7. The combination as set forth in claim 6, wherein a panel is added between said shelf extensions so to complete said office machine platform when the first said partitions are installed further apart from each other and their shelf extensions do not abut together.

8. The combination as set forth in claim 7, wherein a plurality of three spaced-apart telescoping posts between said shelf extension panel and a plate thereabove provide selected tilt for said plate, and said office machine is affixed upon said plate, each said post comprising a threaded bolt having a universal joint at its head secured to said plate, said bolt engaging a threaded nut clamped to said panel.

9. The combination as set forth in claim 8, wherein a desk housing is below said desk top and includes at least on pedestal containing a plurality of stacked drawers supported between endless, rotatable chains for selective positions said drawers under a closable opening in said desk top.

10. The combination as set forth in claim 9, wherein means are included for also sliding said drawers horizontally in openings through a front wall of said pedestal.

11. The combination as set forth in claim 10, wherein a rotatably lap drawer underneath said desk top is supported slidably free within a channel-shaped bracket pivotally mounted on an underside of said desk top, said drawer having a pull knob on each opposite end for being outwardly pulled from either side of said bracket for access from a front side of a desk directly into either opposite end of said drawer.

12. The combination as set forth in claim 11, wherein a rotatable circular shelf is within said conduit, and an opening in each said arcuate portion of said conduit side wall permits access to said shelf from every bay of said module.

13. The combination as set forth in claim 12, wherein a carrier is removably stored upon said rotatably circular shelf, and lazy tong means between said carrier and said shelf for projecting said carrier outwardly therefrom.

14. The combination as set forth in claim 13, wherein said extra partition includes a desk, a desk top of said desk being affixed to a side of said partition, and a pedestal of said desk being slidably attached under said desk top by dove-tailed rails and grooves therebetween.

15. The combination as set forth in claim 13, wherein said extra partition includes an elevating mechanism attached thereto, said mechanism vertically adjusting a desk top of a desk or a shelf alongside said extra partition.

16. The combination as set forth in claim 15, wherein said improved modular work station includes a set of said slats for selective installation in said conduit frame, dependent on a number of said bays and first said partitions, said set including a slat for each one of the first said partitions and which is fitted with a connector for attachment of said partition to said conduit, a wide slat having wide openings for ventilating each one of said bays, and a plurality of plain narrow slats for closing a remaining space on said conduit frame so to complete said enclosing side wall.

* * * * *